United States Patent [19]

Fricker

[11] Patent Number: 4,634,164

[45] Date of Patent: Jan. 6, 1987

[54] HOISTING ASSEMBLY WITH QUICK-RELEASE HOISTING SHACKLE

[76] Inventor: Siegfried Fricker, Wurmberger Str. 30-34, 7135 Wiernsheim, Fed. Rep. of Germany

[21] Appl. No.: 728,096

[22] Filed: Apr. 29, 1985

[30] Foreign Application Priority Data

Apr. 28, 1984 [DE] Fed. Rep. of Germany ..... 3415884

[51] Int. Cl.[4] ..... B66C 1/34; B66C 1/66

[52] U.S. Cl. ..... 294/89; 294/82.24; 52/125.5

[58] Field of Search ..... 294/89, 82.24, 82.11, 294/82.1, 82.22, 85, 84, 106, 118; 24/241 R, 241 P, 230.5 R, 232 R, 233; 52/125.5, 698, 699, 700; 59/85, 89, 93

[56] References Cited

U.S. PATENT DOCUMENTS 3,284,125 11/1966 Blaske, Sr. et al. ..... 294/89

3,883,170 5/1975 Fricker et al. ..... 294/89

4,173,856 11/1979 Fricker ..... 294/89

4,417,425 11/1983 Case et al. ..... 294/89

*Primary Examiner*—James B. Marbert

*Attorney, Agent, or Firm*—Joseph A. Geiger

[57] ABSTRACT

A hoisting assembly with a quick-release shackle for the connection of a hoisting harness to an anchoring member embedded in a precast concrete building element, for the tilt-up and transport of the latter, the assembly comprising a ring part reaching through the central opening of the hoisting shackle and a link plate attached to the ring part at a split hub portion of the ring part which is welded after insertion into the hoisting shackle. The link plate, oriented perpendicularly to the ring part, is attached thereto by means of a weld, or by means of an internally threaded axial extension engaging a male thread on the hub portion of the ring part. The link plate extension may include a threaded sleeve and a connecting screw about which the link plate is rotatable.

9 Claims, 7 Drawing Figures

HOISTING ASSEMBLY WITH QUICK-RELEASE HOISTING SHACKLE

BACKGROUND OF THE INVENTION

1. Field of the Invention

The present invention relates to hoisting means and, more particularly, to a hoisting assembly for the releasable connection of a hoisting harness to a precast concrete building element by means of a quick-release hoisting shackle cooperating with an anchoring member which is permanently embedded in the precast concrete element, for the tilt-up and transport of the precast element.

2. Description of the Prior Art

A quick-release hoisting shackle of the type referred to above is known from the German Pat. No. 22 40 171 and from the corresponding U.S. Pat. No. 3,883,170. Special anchoring members for the tilt-up of precast concrete elements with this hoisting shackle are suggested in the German Pat. No. 27 20 148 and in the corresponding U.S. Pat. No. 4,173,856.

The known hoisting shackle consists of a shackle body in the shape of a hollow torus, an arcuate locking bolt being guided for displacements inside its circular cavity. The locking bolt is movable between a locking position in which it is engaged across an eye hole in the eye portion of the embedded anchoring member and a release position in which the shackle body, which has a transverse slot receiving the eye portion, is engageable over and removable from the eye portion of the anchoring member.

The anchoring member is a "lost anchor", being positioned below the edge surface of the precast concrete member. The exposed eye portion of the anchoring member is located within an oblong engagement recess which approximately matches the shape of the shackle body.

Connecting the hoisting shackle to a hoisting harness is an attachment link which resembles a large chain link with two transverse apertures, the larger upper aperture serving for the engagement of a hook or cable sling of the hoisting harness and the smaller lower aperture receiving the upper portion of the shackle body. The attachment link remains attached to the hoisting shackle.

The tilt-up anchoring members which are suggested in U.S. Pat. No. 4,173,856 have an eye portion with a shape that includes one central or two laterally spaced longitudinal extensions or noses which cooperate with the shackle body in such a way that the latter remains substantially aligned with the anchoring member, even if pulled in a direction which is inclined as much as 90° from the axis of the anchoring member.

This device makes it possible to tilt a precast concrete component from its initially horizontal orientation into a vertical orientation in which it is to be transported and/or installed, while preventing the shackle body from bearing against the flank of the engagement recess in the horizontal orientation of the precast member. This feature is necessary, in order to prevent spalling of the concrete in the area of the engagement recess, especially in the case of a thin precast element.

It has now been found that, in the case of certain precast concrete components, the known combination of a hoisting shackle with a special tilt-up anchoring member, as described above, has some shortcomings in connection with tilt-up operations, especially when the precast element has an edge profile with a protruding lip, or when it is necessary to recess the anchoring member as deeply as possible from the edge of the precast element. Both conditions are encountered in connection with thin precast plates which are used for walls and ceilings.

SUMMARY OF THE INVENTION

Underlying the present invention is the primary objective of devising an improved hoisting assembly which uses the above-described quick-release hoisting shackle in connection with tilt-up operations on precast concrete elements having special edge profiles and/or requiring a more deeply recessed location of the anchoring members in the concrete.

The present invention proposes to attain this objective by suggesting a hoisting assembly comprising a ring part which is permanently connected to the torus-shaped hoisting shackle by reaching through its central opening in the manner of a chain link and a link member or link plate which is attached to the ring part in longitudinal alignment therewith.

The ring part has a radial slit which is necessary for the insertion of the ring part through the central opening of the shackle body in connection with bending operations on the ring part before and after insertion. The inserted ring part is rejoined at its radial slit by means of a weld.

In a preferred embodiment of the invention, the ring part includes a hub portion which is bisected by the radial slit, the hub portion serving for the connection of the ring part to the link plate, either in a permanent attachment obtained by means of a weld, or in a disconnectable attachment obtained by means of cooperating threads.

For a permanent attachment between the ring part and the link plate, the latter has a central slot across its thickness, into which the hub portion of the ring part is engaged in such a way that the two parts have a common longitudinal axis and their major planes are oriented perpendicularly to each other. Corner welds join the hub portion of the ring part to the edges of the central slot of the link plate.

For a disconnectable attachment between the ring part and the link plate, the hub portion of the ring part is machined into the shape of a cylindrical trunnion with a male thread, following reclosing and welding of the ring part, and the link plate is provided with an axial extension having a matching female thread.

The axial extension of the link plate may take the form of a threaded sleeve which is attached to the link plate by means of a connecting screw reaching through an axial bore of the link plate. By securing the connecting screw against rotation relative to the threaded sleeve, it is possible to use the shaft of the connecting screw as a support about which the link plate is rotatable.

Lastly, the link plate may take the shape of an eye part with a shape which is similar to that of the ring part, but preferably smaller in diameter, the eye part having a small central eye hole for the passage of a steel cable of the hoisting harness.

The proposed novel hoisting assembly makes it possible to arrange the eye portion of the embedded anchoring member at a greater depth from the edge of the precast concrete element, without causing the hoisting assembly to bear against the edge surface or against an upstanding lip profile of a horizontally oriented precast element in the course of a tilt-up operation.

The deeper attachment position of the hoisting shackle inside the concrete offers the additional advantage of eliminating the need for the previously required special tilt-up anchoring elements, since the deeper position of the hoisting shackle permits an attachment configuration in which the upper flank of the hoisting shackle bears directly against the flank of the recess at a point which is located far enough from the edge of the recess that spalling will not occur during the tilt-up operation. The cost advantages of this feature are obvious.

Lastly, the use of a threaded attachment has the advantage of making the hoisting assembly adaptable to a variety of hoisting needs. The threaded sleeve serves as an easily adaptable intermediate member of minimal space requirements in the transverse sense, with the additional advantage of providing rotational freedom for the link plate.

BRIEF DESCRIPTION OF THE DRAWINGS

Further special features and advantages of the invention will become apparent from the description following below, when taken together with the accompanying drawing which illustrates, by way of example, preferred embodiments of the invention which are represented in the various figures as follows.

DESCRIPTION OF THE PREFERRED EMBODIMENTS

Figure 1:
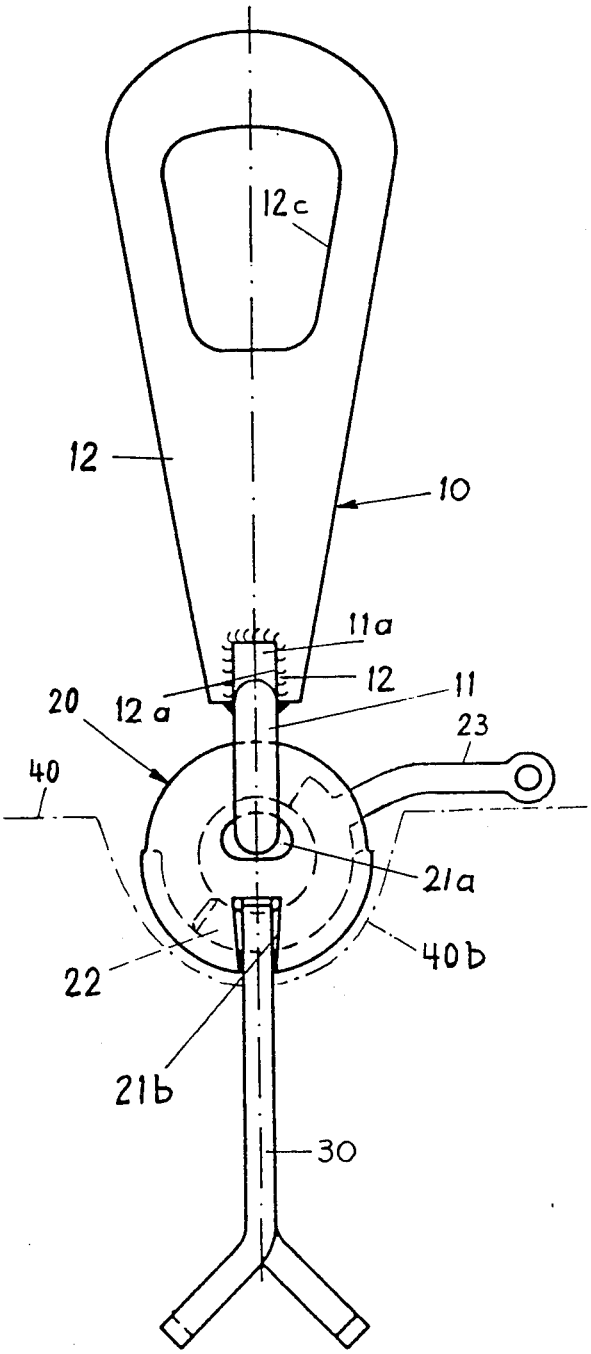
FIG. 1 shows, in an elevational view, a first embodiment of a hoisting assembly for the attachment of a hoisting harness with a quick-release hoisting shackle to a precast concrete element.
Figure 2:
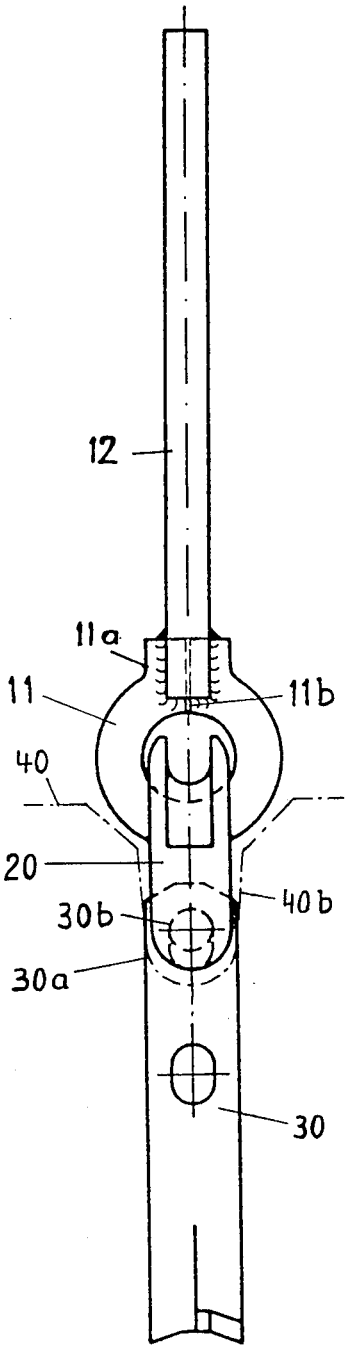
FIG. 2 shows the hoisting assembly of FIG. 1 in a side view.

Referring to FIGS. 1 and 2 which show a first embodiment of the invention, it can be seen that the proposed hoisting assembly consists essentially of three principal parts which are linked together in the manner of a chain: an attachment link 10, a hoisting shackle 20, and an anchoring member 30.

Whereas the connection between the attachment link and the hoisting shackle 20 is a permanent one, the connection between the hoisting shackle 20 and the anchoring member 30 is releasable, as will become clear from the description following below.

The attachment link 10 consists of a ring part 11 and a link plate 12. The ring part 11 reaches through a central opening 21*a* of the hoisting shackle 20, adjoining the lower extremity of the link plate 12 with a rectangular hub portion 11*a* which engages a central vertical recess 12*a* in the link plate 12. A number of corner welds 12*b* form of strong junction between the ring part 11 and the link plate 12.

The ring part 11 is preferably an annular steel forging. In order to insert the ring part 11 through the central opening 21*a* of the hoisting shackle 20, it is split open along a radial slit 11*b* which bisects its hub portion 11*a*. The split ring part 11 is bent open, so that it can be inserted through the central opening 21*a* of the shackle 20, and the inserted ring part is bent back into its annular shape, whereupon the rejoined halves of its hub portion are inserted into the vertical recess 12*a* of the link plate 12 for the welding operation.

The link plate 12 is a flat metal plate of generally triangular shape with a large eye 12*c* for the insertion of a hook, cable, or other suitable connecting member of a hoisting harness (not shown). The major plane of the link plate 12 is perpendicular to the major plane of the ring part 11. In FIG. 2, it can be seen that the major plane of the link plate 12 is substantially aligned with the major plane of the hoisting shackle 20, when the attachment link 10 is pulled in the direction of the axis of the anchoring member 30.

The hoisting shackle 20 and the anchoring member 30 are known form U.S. Pat. No. 3,883,170. The hoisting shackle 20 consists of a shackle body 21 in the form of a hollow torus, its arcuate cavity serving as a guide for an arcuate locking bolt 22 to which is attached a radially extending release lever 23. In its locking position which is indicated in FIG. 1 by dotted lines, the arcuate locking bolt 22 reaches across a radial engagement slot 21*b* in the shackle body 21 and through the eye hole 30*b* in the eye portion 30*a* of the anchoring member 30 which is engaged in the slot 21*b*.

An upward movement of the release lever 23 retracts the locking bolt 22 to a release position (not shown) in which the eye portion 30*a* of the anchoring member 30 is free to move into or out of the engagement slot 21*b* of the shackle body 21. The anchoring member 30 is permanently embedded in the precast concrete element 40, in the center of an oblong recess 40*b* which is deep enough to receive a major portion of the hoisting shackle 20, as well as a portion of the ring part 11.

Figure 3:
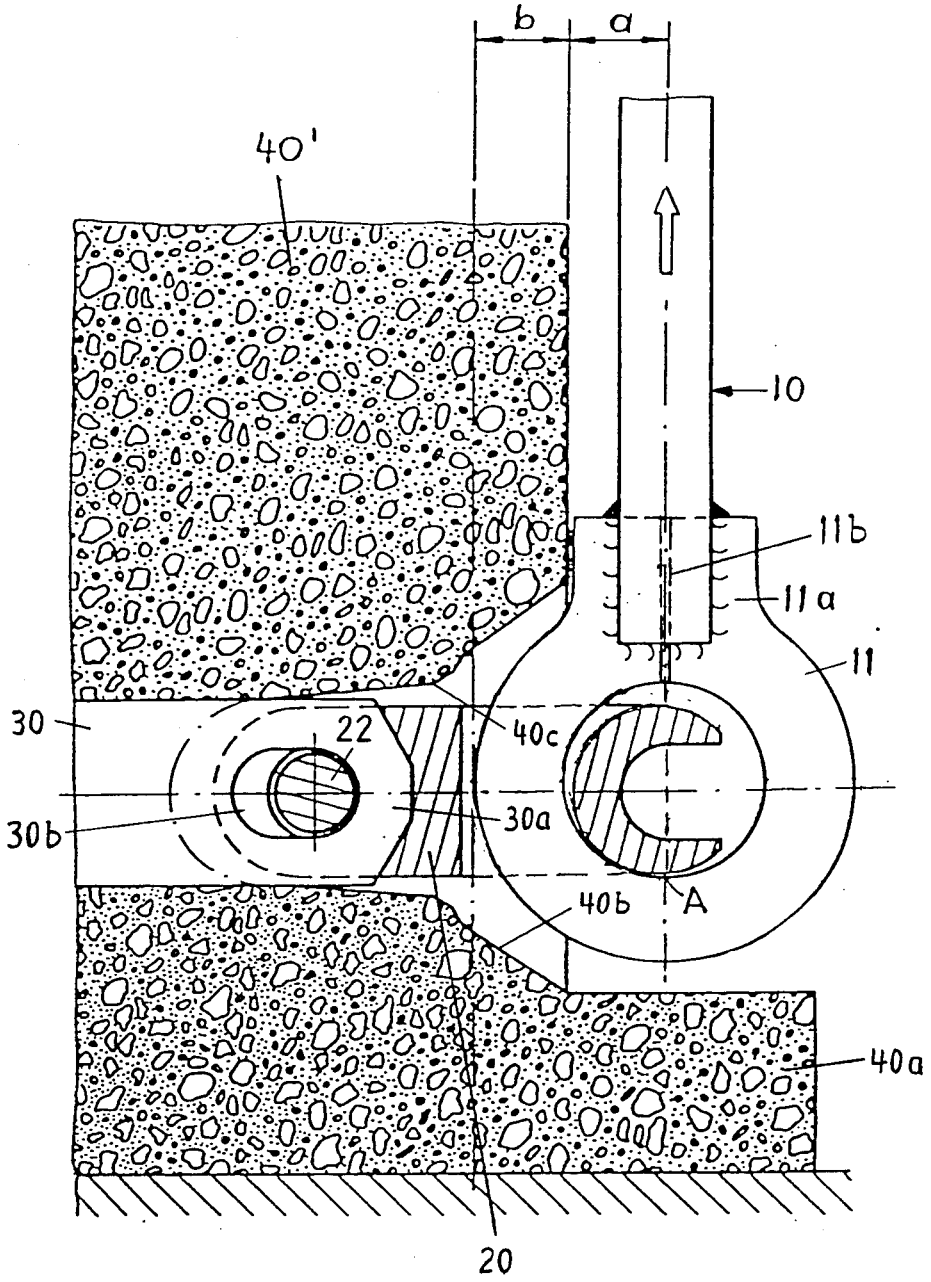
FIG. 3 shows an enlarged partially sectioned portion of the hoisting assembly of FIG. 2, as attached to a horizontally oriented precast concrete element.
Figure 4:
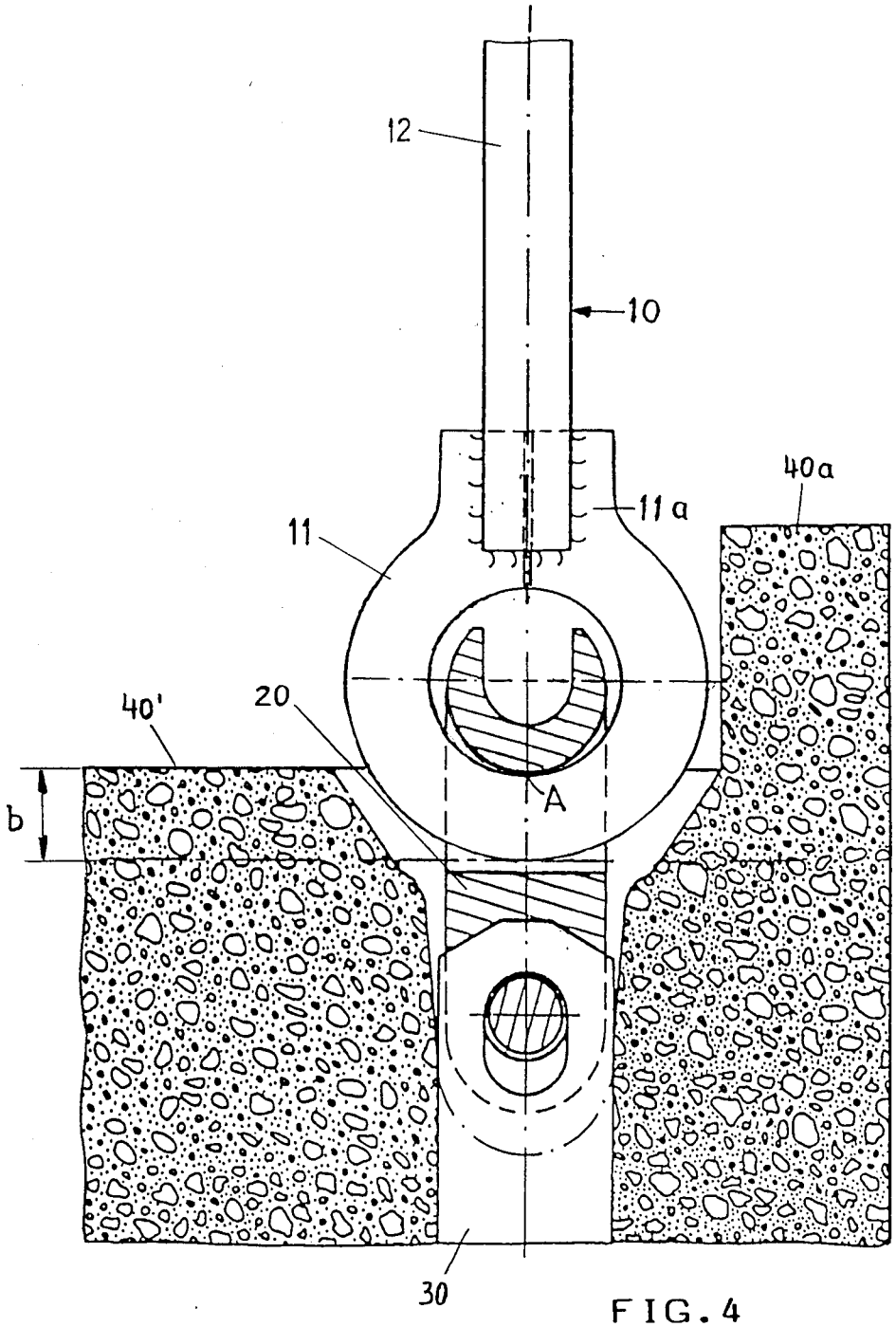
FIG. 4 is similar to FIG. 3, showing the precast concrete element in a vertical orientation.

FIGS. 3 and 4 show the application of the hoisting assembly of FIGS. 1 and 2 in connection with a tilt-up operation in which a precast concrete plate 40' is lifted on one of its edges from its horizontal casting orientation to a vertical transport orientation.

The concrete plate 40', serving as a wall element, for example, has on its edge an upstanding lip profile 40*a* which must not come into force-transmitting contact with the hoisting assembly, lest it be chipped or broken off. In FIG. 3 it can be seen how the proposed attachment link 10 of the novel hoisting assembly makes it possible to move the axis of upward pull closer to the edge of the precast plate 40', as reflected by the distance a between the major plane of the link plate and the edge surface of the precast plate 40. The depth of penetration of the ring part 11 into the recess 40*b* is indicated by the distance b.

As the hoisting assembly is pulled upwardly in the direction of the arrow in FIG. 3, the hoisting shackle first executes a small pivoting displacement, until its upper flank comes into force-transmitting contact with the corner 40*c* of the recess 40*b*. Because the corner 40*c* is formed of an obtuse angle and located a considerable distance below the edge surface of the plate 40', the concrete forming this corner will safely support the pressure exerted against it by the hoisting shackle 20 during the tilt-up operation.

FIG. 4 shows the precast concrete plate 40' in the vertical orientation. There, it can be seen that the shape of the ring part 11 of the attachment link 10 is such that the lip profile 40*a* remains free of contact, should the tilt-up operation cause the precast concrete plate 40' to swing beyond the vertical alignment position.

The deeply recessed anchoring member 30 offers the further advantage of an improved protection for the anchoring member against corrosion, as its eye portion 30*a* will be covered by a thicker layer of concrete.

Figure 5:
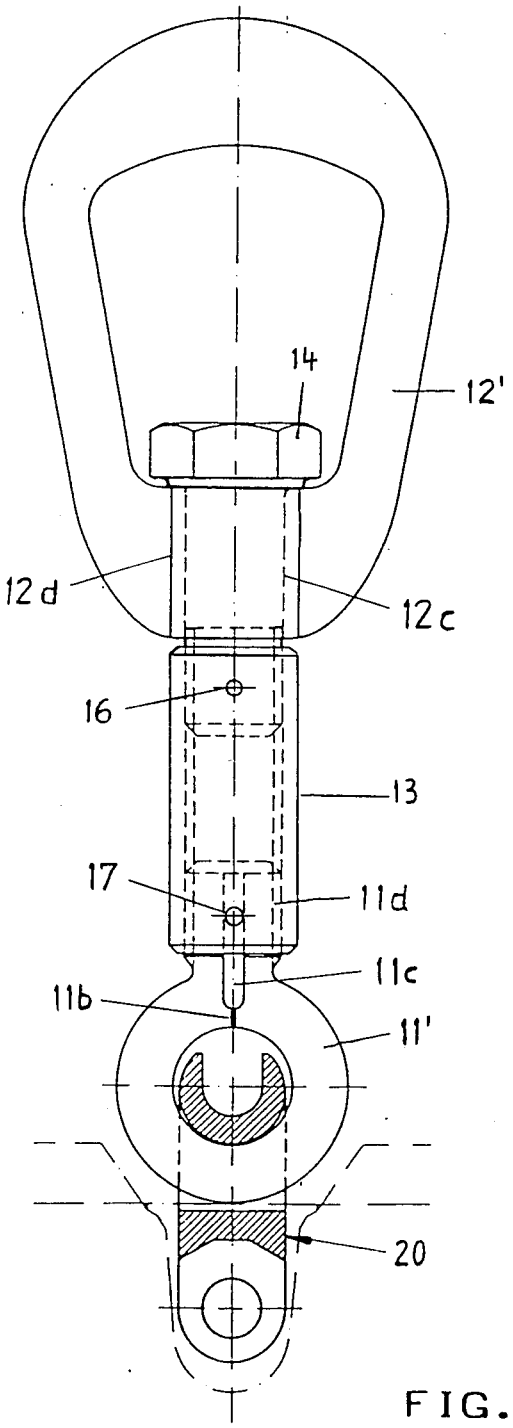
FIG. 5 shows, in a side view which is similar to FIG. 2, a second embodiment of the invention using the same quickrelease hoisting shackle.

FIG. 5 shows a second embodiment of the invention featuring an attachment link 12' which consists of an assembly of a modified ring part 11', a threaded sleeve 13, a modified link plate 12', and a connecting screw 14.

The ring part 11', instead of having a rectangular hub portion as in the embodiment of FIGS. 1–4, has a hub portion 11*a'* in the form of an externally threaded cylindrical trunnion. The forged ring part 11 is again split open along a radial slit 11*b*, bent open for insertion through the central opening of the hoisting shackle 20, and bent back into its annular shape, before being rejoined by welds 11*c* along the radial slit 11*b*. Finally, the welded hub portion 11*a'* is machined into a cylindrical shape with a male thread 11*d*.

The threaded sleeve 13 has its lower end portion threaded over the hub portion 11*a'* of the ring part 11' and its upper end portion engaged by the connecting screw 14. The latter reaches through a vertical bore in a eye 12*c* of the link plate 12' without clamping the threaded sleeve to the link plate 12'. The shaft of the connecting screw 14 thereby serves as a rotational support for the link plate 12' which is free to rotate about the axis of the hoisting assembly. A pin 16 secures the connecting screw 14 in relation to the threaded sleeve 13. A second pin 17 secures the threaded sleeve 13 in relation to the ring part 11'.

This arrangement has the advantage of relieving the hoisting assembly of any rotational forces which may otherwise be transmitted to the hoisting assembly by the hoisting harness. The use of a threaded sleeve as an intermediate connecting member makes it possible to shorten or lengthen the hoisting assembly at little expense, in accordance with the specific requirements of the hoisting operation.

Figure 6:
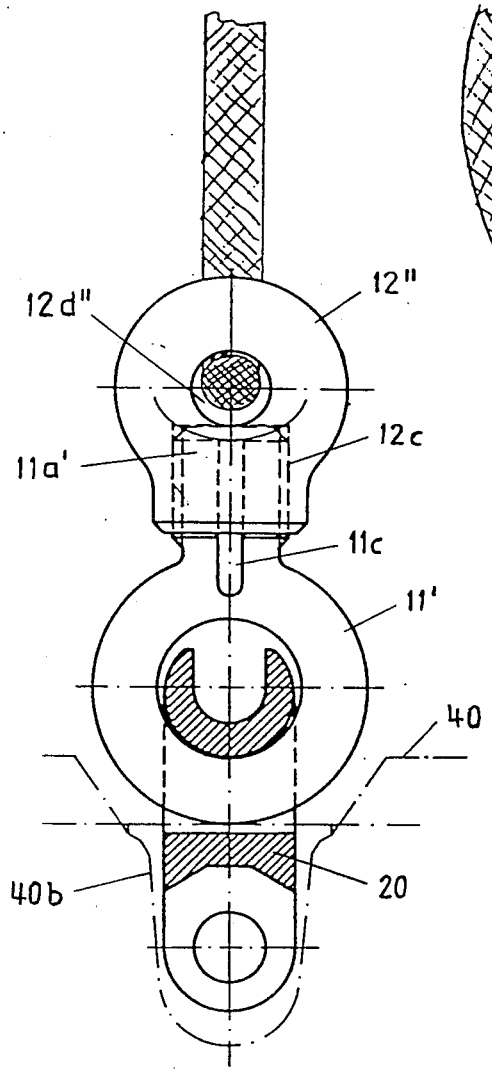
FIG. 6 shows, in another side view, a third embodiment of the invention.
Figure 7:
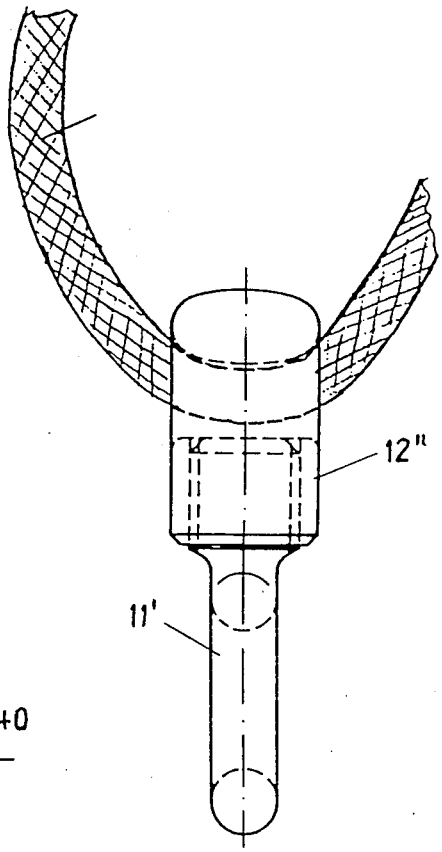
FIG. 7 shows a portion of the hoisting assembly of FIG. 6 in an elevational view.

FIGS. 6 and 7 show a third embodiment of the invention featuring the use of the ring part 11' of the embodiment of FIG. 5 in conjunction with an eye part 12'' which takes the place of the threaded sleeve and the link plate 12'. The eye part 12'' has a female thread 12*c* with which is engages the threaded hub portion 11*a'* of the ring part 11' and a small central opening 12*d* for a hoisting cable 15.

This embodiment forms a very compact hoisting assembly which requires a minimum of space in the longitudinal sense as well as in the transverse sense. It should be understood that, while the drawing shows the ring part 11' and the eye part 12'' angularly aligned in a common plane, their threaded connection allows for the orientation of the eye part 12'' in any angular position relative to the ring part 11'.

The threaded hub portion 11*a'* of the ring part 11' has the advantage of lending itself to a variety of connection configurations. Thus, it will be readily apparent that it is possible to combine the above-described second and third embodiments in the form of a hoisting assembly in which the eye part 12'' is connected to the ring part 11' by means of an intermediate threaded member which is comparable to the threaded sleeve 13 of FIG. 5. Unlike the latter, however, this intermediate threaded member would have a male thread on its upper end and a female thread on its lower end.

It is to be understood that the invention is not limited in its application to the details of construction and arrangement of parts illustrated in the accompanying drawings, since the invention is capable of other embodiments and of being practiced or carried out in various ways. It is also to be understood that the phraseology or terminology employed herein is for the purpose of description and not of limitation.

I claim the following:

1. A hoisting assembly adapted for the releasable connection of a hoisting harness to a load, particularly to a precast concrete element which has at least one anchoring member embedded therein, the hoisting harness comprising in combination:

an exposed eye portion on one end of said anchoring member, the eye portion having an eye hole extending transversely therethrough;

a hoisting shackle having an annular shackle body with a central opening and a locking bolt with is movable in relation to the shackle body, the locking bolt being engageable through the eye hole of the anchoring member to establish a connection between the hoisting shackle and the precast element, and the locking bolt being retractable to release the hoisting shackle from the precast element;

a ring part which is permanently connected to the hoisting shackle in the manner of a chain link, the ring part having a radial slit for the insertion of the ring part through the central opening of the shackle body in connection with bending operations on the ring part before and after insertion, the ring part being rejoined at its radial slit by a weld; and a link member which is attached to the ring part in the area of its radial slit, in a configuration in which the ring part and the link plate maintain a common longitudinal axis, the link member having an eye through which an extremity of the hoisting harness is insertable to attach the hoisting harness to the hoisting assembly.

2. A hoisting assembly as defined in claim 1, wherein the attachment between the ring part and the link member is a disconnectable attachment.

3. A hoisting assembly as defined in claim 1, wherein the link member is an elongated link plate, said eye being arranged near one longitudinal extremity of the link plate, and said attachment to the ring part being in the area of the other longitudinal extremity of the link plate.

4. A hoisting assembly as defined in claim 3, wherein the ring part includes a hub portion which is bisected by said radial slit;

the link plate includes, on its extremity which is attached to the ring part, a central recess in the form of a slot which extends through the thickness of the plate, receiving therein the hub portion of the ring part; and the ring part and the link plate are attached to each other by means of a weld, in a configuration in which the major planes of the ring part and link plate are perpendicular to each other.

5. A hoisting assembly as defined in claim 3, wherein the ring part includes a hub portion which is bisected by said radial slit, the hub portion having the form of a radially outwardly extending trunnion with a male thread thereon; and the link plate includes, on its extremity which is attached to the ring part, a threaded bore cooperating with the male thread of the ring part to attach the link plate to the ring part.

6. A hoisting assembly as defined in claim 5, wherein the link plate includes, on its extremity which is attached to the ring part, an axial extension defining said threaded bore for the attachment of the link plate to the ring part.

7. A hoisting assembly as defined in claim 5, wherein the link plate includes, on its extremity which is attached to the ring part, an axial extension in the form of a threaded sleeve, one end portion of the threaded sleeve engaging the threaded trunnion of the ring part;

the link plate further has a longitudinal throughbore in alignment with said common longitudinal axis, the throughbore extending from said attached extremity to the eye of the link plate; and the link plate further includes a screw reaching from the eye of the link plate through the throughbore into the other end portion of the threaded sleeve to attach the link plate to the ring part in a configuration in which the link plate is rotatable about the shaft of said screw.

8. A hoisting assembly as defined in claim 7, wherein the link plate has an eye formation surrounding its longitudinal bore; and the screw is secured in relation to the threaded sleeve by means of a transverse pin.

9. A hoisting assembly as defined in claim 1, wherein the ring part includes a hub portion which is bisected by said radial slit, the hub portion having the form of a radially outwardly extending trunnion with a male thread thereon; and the link member is a ring member of an outer diameter which is comparable in size to the outer diameter of the ring part, said ring member having an extension with a threaded bore cooperating with the male thread of the ring part to attach the link plate to the ring part.

* * * * *